US008518502B2

(12) United States Patent
Bona et al.

(10) Patent No.: US 8,518,502 B2
(45) Date of Patent: Aug. 27, 2013

(54) BIODEGRADABLE INFLATABLE DEVICE

(76) Inventors: Frank Bona, Chagrin Falls, OH (US); David A. Schiraldi, Shaker Heights, OH (US)

( * ) Notice: Subject to any disclaimer, the term of this patent is extended or adjusted under 35 U.S.C. 154(b) by 444 days.

(21) Appl. No.: 12/924,530

(22) Filed: Sep. 29, 2010

(65) Prior Publication Data

US 2011/0076911 A1 Mar. 31, 2011

Related U.S. Application Data

(60) Provisional application No. 61/277,769, filed on Sep. 29, 2009.

(51) Int. Cl.

| | |
|---|---|
| ***B32B 1/00*** | (2006.01) |
| ***B32B 1/02*** | (2006.01) |
| ***B28B 1/38*** | (2006.01) |
| ***B29C 67/24*** | (2006.01) |
| ***B29C 39/14*** | (2006.01) |
| ***B29C 49/00*** | (2006.01) |
| ***B29C 55/00*** | (2006.01) |
| ***D01F 4/00*** | (2006.01) |
| ***D01F 1/02*** | (2006.01) |

(52) U.S. Cl.

USPC ..... 428/35.2; 428/34.1; 428/34.4; 428/34.6; 428/34.7; 428/35.4; 428/35.5; 428/35.7; 428/36.4; 428/36.6; 428/36.7; 428/36.8; 428/36.92; 264/202; 264/211; 264/301; 264/330; 264/564; 427/2.1

(58) Field of Classification Search

USPC ..... 428/34.1, 34.4–34.7, 35.2–35.9, 428/36.4, 36.6–36.92; 264/202, 211, 301, 264/330, 564; 427/2.1

See application file for complete search history.

(56) References Cited

U.S. PATENT DOCUMENTS

| | | | | |
|---|---|---|---|---|
| 7,815,624 | B2 * | 10/2010 | Larson | 604/523 |
| 2003/0118692 | A1 | 6/2003 | Wang et al. | |
| 2006/0193892 | A1 | 8/2006 | Furst et al. | |
| 2007/0207183 | A1 * | 9/2007 | Ruane et al. | 424/423 |

FOREIGN PATENT DOCUMENTS

| | | |
|---|---|---|
| JP | 06-142343 | 5/1994 |
| JP | 2007-117355 | 5/2007 |
| JP | 2007-301276 | 11/2007 |

* cited by examiner

*Primary Examiner* — Walter B Aughenbaugh

(74) *Attorney, Agent, or Firm* — Hudak, Shunk & Farine Co. LPA

(57) ABSTRACT

An inflatable device, in particular a device including a body having an outer surface and an inner surface, the inner surface accessible through an orifice in the body, the body including a prolamine protein that exhibits air or gas impermeability for a suitable period of time, and yet is biodegradable upon exposure to the environment. The device can be utilized as a balloon for personal uses such as toys, gifts or balloon releases at events, or as a medical device.

19 Claims, 2 Drawing Sheets

BIODEGRADABLE INFLATABLE DEVICE

CROSS REFERENCE TO RELATED APPLICATIONS

This application claims priority to U.S. Provisional Patent Application No. 61/277,769, which was filed on Sep. 29, 2009.

FIELD OF THE INVENTION

The present invention relates to an inflatable device, in particular a device that exhibits a desirable amount of air or gas impermeability for a suitable period of time, and yet is biodegradable upon exposure to the environment over time. The device can be utilized as a balloon for personal uses such as toys, gifts or balloon releases at events, or even as a medical device.

BACKGROUND OF THE INVENTION

Inflatable devices such as balloons have been made from various materials. Previous efforts have been presented in order to attempt to provide a balloon that dissolves or decomposes in a natural environment.

U.S. Patent Application Publication No. 2003/0118692 relates to a biodegradable polymer comprising a condensation polymer of glycerol and a diacid. The polymer may be adapted for use as a tissue engineering construct. For example, it may be seeded with cells, or molecules may be attached to it to modify the metabolism and proliferation of cells or to modify the degradation rate and/or mechanism of the polymer. The polymer may also be exploited in a variety of medical and non-medical applications.

U.S. Patent Application Publication No. 2006/0193892 relates to a medical device that is at least partially formed of a biodegradable polymer. The medical device can be at least partially formed by MEMS technology. The medical device can include one or more micro-structures that are also formed by MEMS technology. The medical device can include one or more biological agents that reportedly can be controllably and/or uncontrollably released from the medical device.

Japanese Publication No. 06-142343 relates to reportedly giving biodegradability, rain-resistance and water-solubility to a balloon and reportedly eliminating the environmental contamination by a method where the outside of a balloon is reportedly formed of an airtight, water-proof and biodegradable resin layer, and the inside is reportedly formed of an airtight and water-soluble, or water-dispersible resin layer.

Japanese Publication No. 2007-117355 relates to providing a constitution of a balloon by material where temperature with sunlight and both of oxidative degradation with UV and biodegradation with bacteria can be used together in a natural environment and where the relative amount of inorganic substances which can show the degradation functions can be small.

Japanese Publication No. 2007-301276 relates to providing a balloon which is released to the sky specifically for raising the performance effect regarding the balloon released to sky at an event site performing various outdoor events or the like, and reportedly naturally returns to nature without breaking natural environment after loosing its buoyancy.

SUMMARY OF THE INVENTION

In view of the above, it is an object of the present invention to provide an inflatable device that has low air and gas permeability and is further biodegradable upon exposure to the environment in a relatively short period of time.

A further object of the present invention is to provide a low gas permeable inflatable device that can contain for example, ambient air or a gas lighter than the ambient air such as helium that enables the device to float.

An additional object of the present invention is to provide an inflatable device that can be discarded into the environment and that decomposes into a natural material over a relatively short period of time.

A further object of the present invention is to provide an inflatable device comprising a body that is biodegradable. The body preferably comprises a protein, preferably a plant-based protein, most preferably a prolamine protein in one embodiment.

Still another object of the present invention is to provide an inflatable device including a body formed from a prolamine protein that exhibits low gas permeability, the body having at least one interior chamber having a defined volume and capable of maintaining a gas within the chamber for a suitable period of time.

In one aspect of the present invention, an inflatable device is disclosed, comprising a body having an outer surface and an inner surface, the inner surface accessible through an orifice in the body, the body having an interior chamber bounded by the inner surface with a maximum volume adapted to hold a gas, the body initially having low gas permeability, the body comprising a prolamine protein that is biodegradable over time.

In a further aspect of the present invention, a method for preparing an inflatable device is disclosed, comprising the steps of obtaining a composition comprising a solvent, a prolamine protein and a plasticizer, and producing a body comprising an outer surface and an inner surface, the inner surface accessible through an orifice, from the composition, the body having an interior chamber bounded by the inner surface and having a maximum volume adapted to hold a gas.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

The inflatable devices of the present invention include a body that has an interior chamber that is expandable to a maximum volume and the body preferably has a low permeability to gases, for example air from the ambient environment or a gas generally lighter than the ambient environment, for example helium.

Inflatable devices of the present invention can be for example balloons of any shape or size, or medical devices such as devices used for angioplasty.

Figure 1:
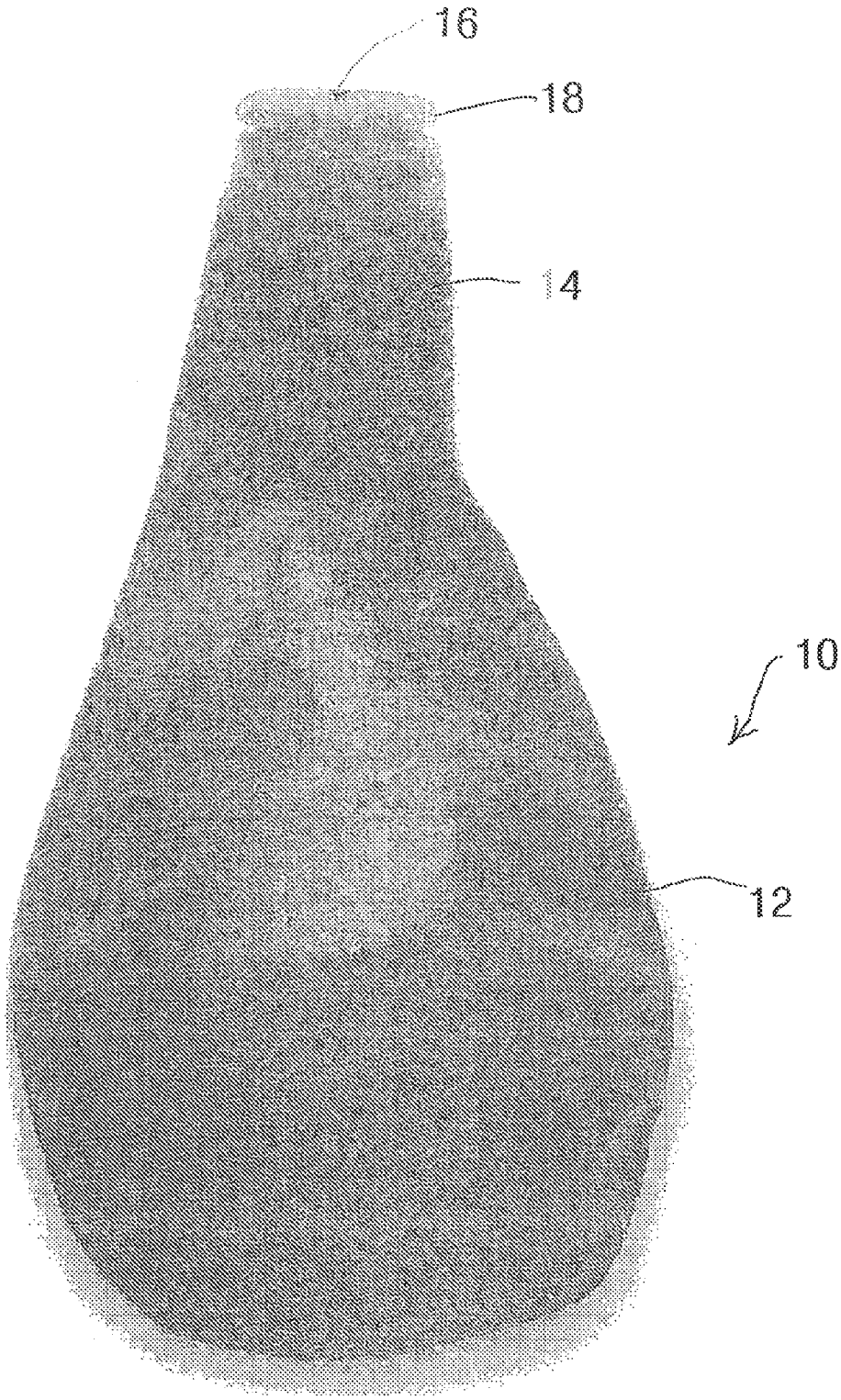
FIG. 1 is a side elevational view of one embodiment of an inflatable device of the present invention.
Figure 2:
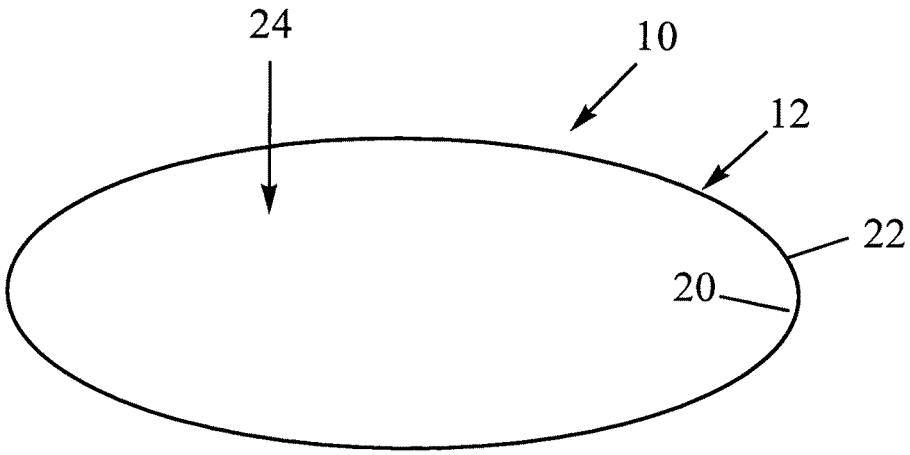
FIG. 2 is a cross-sectional top view of one embodiment of an inflatable device particularly illustrating the inner surface and the interior chamber, the inner chamber inflated with a gas.

One embodiment of the inflatable device of the present invention is illustrated in FIG. 1. FIG. 1 is a side elevational view of an inflatable device 10, in particular a balloon, that includes a body 12, having a neck 14. The inflatable device 10 further includes an aperture or orifice 16 that is illustrated defined by a rim 18 wherein a gas can be input into the device 10. FIG. 2. illustrates a cross-sectional view through an inflatable device 10 containing a gas. The view clearly illustrates inner surface 20 and outer surface 22 of the body 12. The body includes an interior chamber 24 that is inflatable to a maximum volume, the chamber 24 bounded by the inner surface 20 of the body 12. As the device 10 is expandable such as from a compressed or flat state to facilitate storage, transport, shipping, etc to an inflated state with a gas up to a maximum volume, above which the device will burst or pop, the body 12 will expand as a greater amount of gas is added to the device 10 through the aperture or orifice 16. To be understood that one embodiment of the inflatable device is illustrated in FIG. 1, but the device can be formed in substantially any shape or form as known to those of ordinary skill in the art.

The device 10 can include one or more layers of material, with one layer preferred in one embodiment. Likewise, the device can be coated on an inner surface or an outer surface or both with a coating or solution, if desired, such as a water soluble film layer.

The inflatable devices of the present invention comprise a biodegradable polymer, a plasticizer, and one or more additives. The inflatable devices are preferably produced utilizing a process that includes the use of a solvent.

The inflatable devices of the present invention include a biodegradable polymer comprising a prolamine protein. Prolamins are generally a group of plant storage proteins found in the seeds of cereal grains and can be generally further characterized by high glutamine and proline content. Prolamine proteins are generally soluble in alcohols. Prolamine proteins suitable for use in the present invention include gliadin, hordein, secalin, avenin and zein. In a preferred embodiment, the preferred prolamine protein is zein, that is generally found in maize or corn. Pure zein is substantially clear, odorless and tasteless. Corn zein is generally a thermoplastic protein with a hydrophobic nature due to its high content of non-polar amino acids. Corn zein can be obtained as a by-product from corn wet-milling. Prolamine protein, preferably corn zein in one embodiment, comprises a majority by weight of the inflatable devices of the present invention.

One or more plasticizers are preferably present in the compositions utilized to form the inflatable devices of the present invention. Suitable plasticizers include, but are not limited to, glycerol, dibutyl tartrate, various carboxylic acids, for example saturated fatty acids, with specific acids including, but not limited to, lauric acid, oleic acid and stearic acid, glycols such as polyethylene glycol, polypropylene glycol and propylene glycol, sugars (glucose, fructose) and water. In one embodiment, preferred plasticizers are one or more of a carboxylic acid and water. Oleic acid and water are preferred in one embodiment.

One or more additives can be present in the compositions utilized to form the inflatable devices of the present invention. Additives include for example, dyes and pigments that can be utilized to color the inflatable devices to a desired hue. Pigments and dyes can be either organic or inorganic compounds that generally absorb wavelengths of visible light and reflect others.

In addition to the above-identified components, the compositions of the present invention optionally include various additives, fillers, lubricants, stabilizers, processing aids, antidegredants, waxes, fibers such as glass, wood, or cellulose fibers, clay, silica, compatibilizers, flame retardants, dispersing aids, colorants, and the like, which are utilized in conventional amounts as known to the art and to the literature.

The compositions utilized to form inflatable devices of the present invention in one embodiment include one or more solvents that generally dissolve the biodegradable polymer to a desired degree such that the device can be formed therefrom. The type of solvents can vary and for example can be generally any organic solvent, with alcohols being preferred. Examples of suitable solvents include, but are not limited to, acetic acid, acetone, chloroform, diethanolamine, diethylene glycol, diethylenetriamine, ethanol, ethylene glycol, ethylenediamine, formic acid, glycerol, isobutanol, isopropanol, lactic acid, methanol, phenol, propanol, propylene glycol, triethylene glycol and toluene. The amount of solvent utilized depends in part on the remaining components of the composition that are suitable to form the desired finished product, namely the inflatable device. The amount of the solvent can also depend on the process utilized to form the inflatable devices.

Various methods can be utilized to form the inflatable devices of the present invention including, but not limited to, casting, extrusion, molding and dipping. Inflatable devices can be formed by casting the solution into a desired mold and allowing the solvent to evaporate thereby forming the inflatable device. Extrusion generally involves forming a composition comprising a biodegradable polymer, plasticizer and solvent with any desirable additives to form a resin. The resin is preferably dried and fed to an extruder whereby the inflatable device is formed by extruding the composition through a die. In one embodiment, blown film extrusion can be utilized, wherein after exiting the extruder barrel, the resin is transferred to a blowing head where the inflatable device is formed. Molding generally involves processing a resin formed from the desired composition into the desired shape of the inflatable device. The dipping process generally involves dipping a form one or more times into compositions utilized to form the inflatable device and allowing the composition to collect on the form and after the solvent has evaporated, the inflatable device is removed from the form.

Inflatable devices preferably include regular peripheral well thickness, are pinhole free, and are able to form a desirable bead such as a rim 18.

The inflatable devices of the present invention degrade in a suitable period of time which can be modified by the amounts of the components utilized in the device. Incorporation of plasticizer induces formation of protein-plasticizer interaction and consequently the loss of protein-protein interaction. Generally greater amounts of biodegradable polymer result in lower oxygen permeability. Of course, the presence of additives, moisture sensitivity and temperature influence permeability as well. In one embodiment, the body has an oxygen permeability of less than $40\times10^{18}$ mol·m/Pa·sec·m$^2$.

The inflatable devices of the present invention can be utilized to protect the natural resources, as well as animals that depend on natural resources. For example, it is very possible to release helium-filled balloons at various public events. The balloons eventually pop and drift back down to earth. Balloons made out of the compositions of the present invention would degrade upon exposure to the elements. Such balloons could eventually be digested by animals that eat them and would not present a continuing choking risk to animals once they degrade.

In accordance with the patent statutes, the best mode and preferred embodiment have been set forth; the scope of the invention is not limited thereto, but rather by the scope of the attached claims.

What is claimed is:

1. An inflatable device, comprising: a body having an outer surface and an inner surface, the inner surface accessible through an orifice in the body, the body having an interior chamber bounded by the inner surface with a maximum volume adapted to hold a gas which is in direct contact with the inner surface, the body consisting of a single layer comprising a prolamine protein that is biodegradable, wherein the body further comprises a plasticizer.

2. The device according to claim 1, wherein the prolamine protein comprises one or more of gliadin, hordein, secalin, avenin and zein, and wherein the prolamine protein comprises a majority of the weight of the body.

3. The device according to claim 2, wherein the prolamine protein comprises zein.

4. The device according to claim 1, wherein the body comprises a dye or pigment.

5. The device according to claim 1, wherein the body has an oxygen permeability of less than $40\times10^{18}$ mol·m/Pa·sec·$m^2$.

6. The device according to claim 1, wherein the plasticizer comprises an unsaturated fatty acid.

7. A method for preparing an inflatable device, comprising the steps of:

obtaining a composition comprising a solvent, a prolamine protein and a plasticizer; and producing a body having an outer surface and an inner surface, from the composition, the inner surface accessible through an orifice, the body having an interior chamber bounded by the inner surface and having a maximum volume adapted to hold a gas which is in direct contact with the inner surface, the body consisting of a single layer.

8. The method according to claim 7, wherein the solvent comprises an alcohol.

9. The method according to claim 8, wherein the prolamine protein comprises one or more of gliadin, hordein, secalin, avenin and zein, and wherein the prolamine protein comprises a majority of the weight of the body.

10. The method according to claim 9, wherein the prolamine protein comprises zein.

11. The method according to claim 7, wherein the plasticizer comprises a carboxylic acid.

12. The method according to claim 7, wherein the body is cast, extruded, molded or formed from dipping.

13. The method according to claim 12, wherein the body is formed utilizing blown film extrusion.

14. An inflatable device, consisting of:

a body having an outer surface and an inner surface, the inner surface accessible through an orifice in the body, the body having an interior chamber bounded by the inner surface with a maximum volume adapted to hold a gas, the body comprising a prolamine protein, wherein the prolamine protein comprises a majority of the weight of the body, and wherein the body further comprises a plasticizer, wherein the body optionally includes a water soluble film layer as one or more of an inner layer and outer layer of the body.

15. The inflatable device according to claim 14, wherein the prolamine protein comprises one or more of gliadin, hordein, secalin, avenin and zein, wherein the body comprises a dye or pigment.

16. The inflatable device according to claim 15, wherein the body has an oxygen permeability of less than $40\times10^{18}$ mol·m/Pa·sec·$m^2$, and wherein the plasticizer comprises an unsaturated fatty acid.

17. An inflatable device, comprising:

a body having an outer surface and an inner surface, the inner surface accessible through an orifice in the body, the body having an interior chamber bounded by the inner surface with a maximum volume adapted to hold a gas, and wherein the prolamine protein comprises a majority by weight of the inflatable device, wherein the body further comprises a plasticizer.

18. The inflatable device according to claim 17, wherein the prolamine protein comprises one or more of gliadin, hordein, secalin, avenin and zein, wherein the prolamine protein comprises a majority of the weight of the body, and wherein the body comprises a dye or pigment.

19. The inflatable device according to claim 18, wherein the body has an oxygen permeability of less than $40\times10^{18}$ mol·m/Pa·sec·$m^2$, and wherein the plasticizer comprises an unsaturated fatty acid.

* * * * *